United States Patent [19]

Leonhart

[11] 4,004,807

[45] Jan. 25, 1977

[54] TABLE BALL GAME

[76] Inventor: Xaver Leonhart, No. 60 1/3, Harburg b. Landau/Isar, Germany, 8381

[22] Filed: Jan. 14, 1976

[21] Appl. No.: 648,950

[30] Foreign Application Priority Data

Oct. 9, 1975 Germany ..... 2545263

[52] U.S. Cl. ..... 273/41; 273/46; 273/52; 273/54 C; 273/120 A; 273/127 R

[51] Int. Cl.[2] ..... A63D 5/08; A63F 7/02; G07F 17/38

[58] Field of Search ..... 273/41, 40, 46, 52, 273/54 C, 120 A, 127 R

[56] References Cited

UNITED STATES PATENTS

| | | | |
|---|---|---|---|
| 601,626 | 4/1898 | Brooks | 273/52 UX |
| 693,382 | 2/1902 | Downey | 273/41 |
| 1,879,511 | 9/1932 | Rodgers | 273/120 A UX |
| 2,052,584 | 9/1936 | Smith | 273/46 |
| 2,634,977 | 4/1953 | Hunter | 273/40 |

*Primary Examiner*—Anton O. Oechsle
*Attorney, Agent, or Firm*—Brady, O'Boyle & Gates

[57] ABSTRACT

At one end of a playing surface a portion of the playing surface which has a plurality of cylindrical openings therein is connected to pivot downwardly from its normal position in substantial alignment with the playing surface, and a lower plate having pins movably registered in the cylindrical openings and the free ends of which are flush with the playing surface and are adapted to hold game balls in position on the playing surface in the normal position is connected to first be moved by guide members and an operating mechanism away from the playing surface portion to partly retract the pins from the cylindrical openings, next the separated lower plate and playing surface portion are pivoted as a unit about the pivot connection of the latter in a downward direction so balls may rush on the surface portion and fill the openings, and finally the lower plate is returned to its normal position and then the surface portion is returned to its normal position in alignment with the playing surface whereby balls can be selectively discharged from the opposite end of the playing surface toward the balls retained on the free ends of the pins.

8 Claims, 5 Drawing Figures

TABLE BALL GAME

BACKGROUND OF THE INVENTION

1. Field of the Invention

The present invention relates to a ball game which works in a similar manner to ninepin games in which the pins are automatically set up, but which can be produced far less expensively than the latter.

2. Description of the Prior Art

In ninepin games in which the pins are automatically set up, this operation is accomplished by means of devices which have an extremely complicated design and which are especially susceptible to breakdowns. These devices are extremely costly and are definitely unsuitable for automatically setting up balls in children's games.

SUMMARY AND OBJECT OF THE INVENTION

The object of the present invention is to provide a table game that is similar to the game of ninepins or skittles which obviates these disadvantages and which can be produced at a far lower production cost and operating cost, and which can be played by persons of all ages — including children.

A table ball game according to the invention is characterized by an upper plate which is pivotally connected by one of its sides to one of the narrow ends of a long rectangular playing surface which forms the center portion at one end of the playing surface and which slopes downwards towards the end of the playing surface in its normal position and which, in a corresponding position to the ninepins in a ninepin or bowling alley, possesses cylindrical openings which are disposed at right angles to its surface and which have a length and diameter corresponding to the diameter of the game balls; a lower plate disposed parallel to the upper plate and carrying cylindrical pins which fit with play into the cylindrical openings of the upper plate and the upper ends of which are provided with centrally disposed small recesses and in their normal position are terminated approximately in alignment or flush with the surface of the upper plate; a stationary guide extending at right angles to the surface of the plates disposed on the underside of each plate and a device which first lowers the lower plate including the pins from the upper plate by a distance of the full diameter of a game ball, subsequently pivots both plates in the position in which they are separated from one another in a downward direction away from the playing surface about the pivot point of the upper plate, and finally returns the plates in the reverse order to their normal positions.

The drawings show three different embodiments of a ball game according to the invention.

DESCRIPTION OF THE PREFERRED EMBODIMENTS

Figure 1:
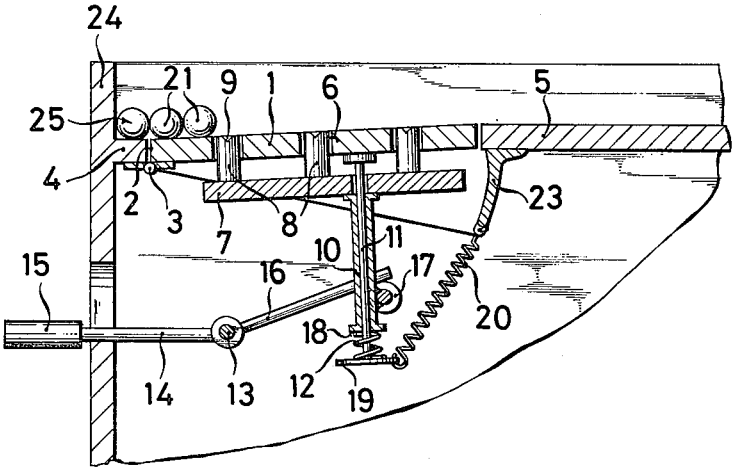
FIG. 1 is a fragmentary vertical, longitudinal sectional view of one end of a mechanically operated ball game according to the invention.

Referring now to FIG. 1, an upper plate 1, which forms a portion of the playing surface, is pivotally connected on one of its ends 2 by means of a hinge 3 to a narrow strip 4 at the end of a long generally horizontal rolling path or playing surface 5. In the normal position indicated in the figure, the plate 1 slopes downwards slightly towards the strip 4 from the playing surface 5. The plate 1 also includes a plurality of cylindrical openings 6 which are arranged according to the arrangement of pins on a ninepin alley or playing surface, and each cylindrical opening has a length and diameter at least corresponding to the diameter of the balls 21 used in the game.

Parallel with the upper plate 1 there is provided a lower plate 7 including protruding cylindrical pins 8 which fit with play into the cylindrical openings 6 of the upper plate 1, the upper ends of the cylindrical pins include centrally disposed small recesses 9 and in their normal position the upper ends terminate approximately in alignment or flush with the surface of the upper plate 1.

Guides 10 and 11 are connected to the underside of the plates 7 and 1, respectively. Guide 10 constitutes a guide tube having a bore in which guide rod 11 is disposed for reciprocal movement. The guides are stationary and directed at right angles to the surface of the plates. A weak spring 12 constantly urges the lower plate 7, through guide tube 10, towards the upper plate 1.

Lastly, there is also provided a device in the form of a two-armed lever 14, including a handle 15 and mounted in a freely pivotal manner on a rod 13 to the game housing. The inner arm 16 of the lever 14 extends over a roller 17 which is mounted in a freely rotatable manner on the guide tube 10.

When the handle 15 is moved upwards in the slot in the outer end wall of the housing, the inner arm 16 of the double-armed lever 14 presses the roller 17 and guide tube 10 downwards and first compresses merely the weak spring 12 such that the pins 8 are moved slightly downwards to the bottom of the openings 6 in the plate 1, thereby forming cavities into which balls can drop and be centrally retained therein by means of the recesses 9. Thereafter, when the double-armed lever 14 is advanced further upwards, the lower end 18 of the guide tube 10 strikes against a disk 19 at the end of the guide rod 11 through the compressed spring and then pushes down guide rod 11 which pivots the two plates 1 and 7 downwards against the force of a more powerful spring 20 about the hinge 3 until the balls 21 which are disposed adjacent to the strip 4 on the inner end of the plate 1 roll onto the remaining part of the now downwardly sloping plate 1 and are only prevented from rolling further by a downwardly projecting arcuate wall 23 on the bottom of the playing surface 5. The row of balls 25 lying adjacent to the outer wall 24 of the game housing remains in its position and will be made available to the players for shooting upon actuation of a specific lever after inserting change into the machine. A small portion of the quantity of balls 21 will roll into the openings 6 which are open due to the withdrawal of the pins 8.

If the handle 15 of the double-armed lever 14 is now released, the powerful spring 20 will first return the two plates 1 and 7 and the balls disposed thereon to the normal position indicated in the drawings; in the course thereof, the balls not retained by the openings 6 in the upper plate 1 will roll back towards the strip 4 and will be accumulated there in several rows 25. The tension of the powerful spring will then be reduced to the extent that the weak spring 12 can return the two plates 1 and 7 to the position indicated in which the balls located in the openings 6 and the recesses 9 are pushed up to the surface of the upper plate 1 and are centrally retained therein by means of the small recesses 9 in the pins 8. A shock absorbing element (not shown) ensures that, in spite of the considerable force of the powerful spring 20, the return movement is effected so slowly that the balls are reliably retained on the recesses 9. The game is once again in the starting position ready for play.

If, for reasons of space, the rolling path or playing surface 5 cannot be made sufficiently long, it is possible to mount a strip of the type used in billiards at the end of the playing surface which is not occupied by balls. The balls are then shot from the side where they are assembled such that they first strike against the strip at the more distant end of the playing surface and are returned from there towards the balls at the other end of the playing surface. This not only provides a playing surface which does not require a great deal of space but it also gives the game the attraction only otherwise found in billiards.

Figure 2:
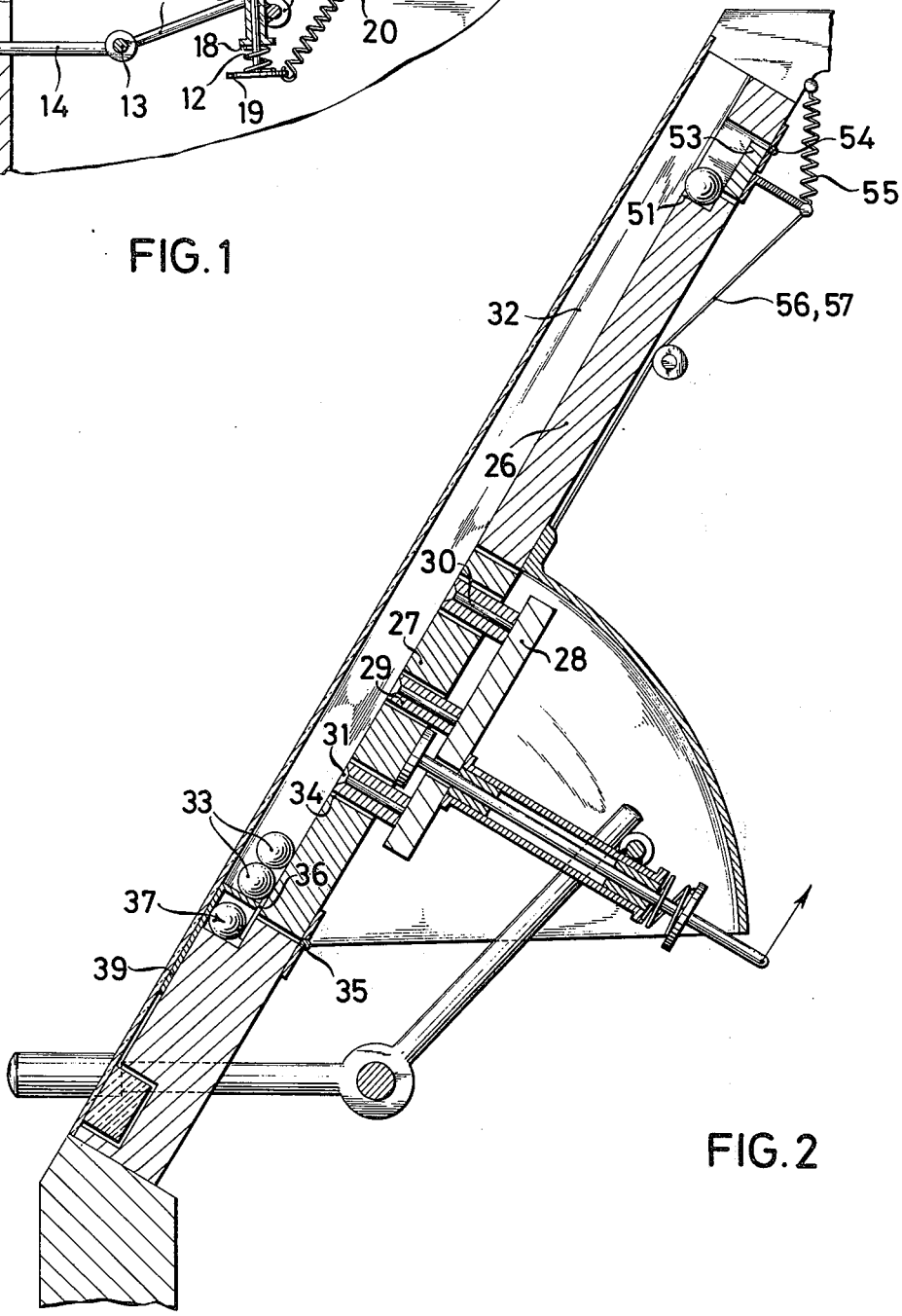
FIG. 2 is a longitudinal sectional view of a modified form of the game, taken along the line II-II of FIG. 3 and showing the drive lever to illustrate the mode of operation of the device.
Figure 3:
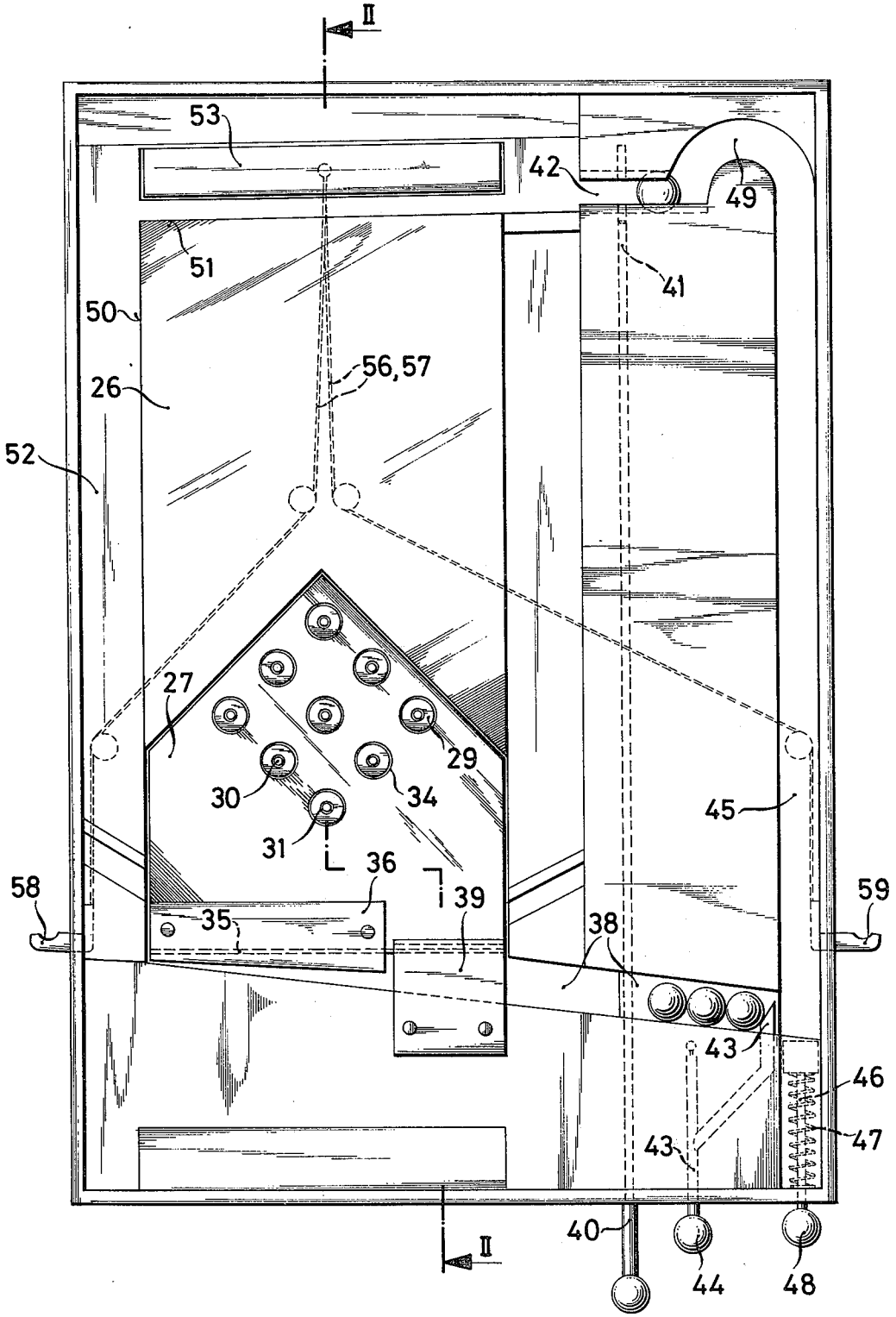
FIG. 3 is a top plan view of the mechanically operated ball game of FIG. 2 comprising an upwardly inclined, shortened rolling path.
Figure 4:
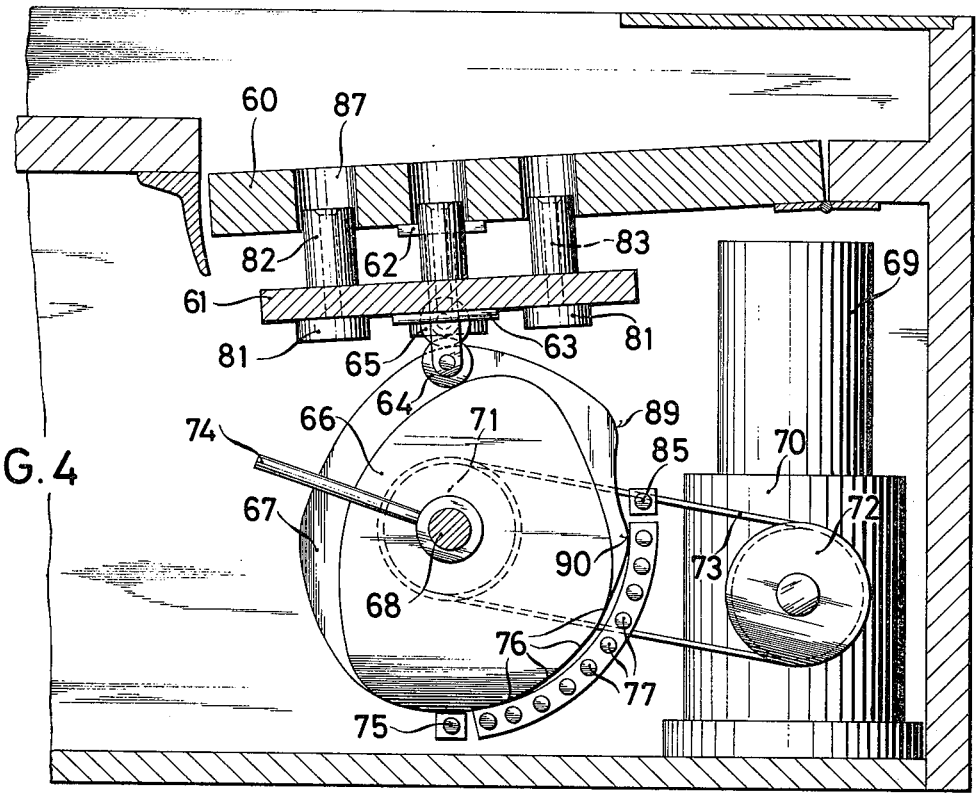
FIG. 4 is a fragmentary vertical, longitudinal sectional view of an electrically operated ball game which is another modified form of the invention.

In the embodiment shown in FIGS. 2 and 3, the play area 26 and the two plates 27 and 28 are disposed at an angle of about 45° with respect to the horizontal. The pins 29 on the lower plate 28 also include permanent magnet rods 30 disposed on the center axes thereof. The rods 30 are capable of retaining the balls 33, constructed of ferromagnetic material, in the middle of the recesses 31 in the pins 29 in spite of the slope of the outer ends of the pins 29. The height of the side wall 32 and in arcuate bottom wall are selected in such a way that even when the two plates 27,28 are pivoted downwards about more than 45° the rolling balls 33 remain on the plate 27 or are caught in the upper part of the openings 34 in the plate 27 from which the pins 29 have been retracted.

A metal plate 36 is mounted over a hinge 35 about which the plate 27 is adapted to be pivoted downwards. This plate 36 is designed firstly to cover the gap produced when the plate 27 is pivoted downwards and secondly to keep the endmost row of balls 37 available for play and to prevent the balls in row 37 from being slowed down by the weight of the balls in rows 33 and from being prevented from entering the run-in channel 38. For this reason, an angle plate 39 is also provided; this provides additional protection for the row of balls 37 from the weight of the rows 33.

At the beginning of the game, a releasing rod 40 is pushed inwards upon insertion of a prescribed number and type of coins. As the rod 40 is pushed inwards an extension 41 of this rod blocks the short run-in groove 42, thereby eliminating the possibility of a player being able to play the game for an unlimited period of time without inserting more coins by purposely jamming the releasing rod 40.

One of the balls from the feed channel 38 is enabled to move into the lower end of a main channel 45 by withdrawing a blocking rod 43 by pulling out on a knob 44 connected thereto. From there it is shot by means of a push rod 46 associated with a pressure spring 47 and a handle 48 along the channel 45 until it reaches a semi-circular groove 49. After leaving the semicircular groove 49 and the short run-in groove 42 it moves onto an area recessed from the playing surface 26 and along the upper end 51 of the playing surface 26; this upper end 51 sloping gently at approximately 90° to the playing surface forms a recessed ball path laterally across the top of the playing surface and projects slightly on the other longitudinal side 50 of the playing surface 26. From there a ball can run until it reaches the return channel 52, which is also recessed relative to the playing surface, in which it rolls back to the remaining balls at the lower end of the playing surface.

A bar 53 is disposed above the upper end 51 of the playing surface 26 in the recessed area and parallel therewith; this bar 53 is pivotable about a hinge 54 and has a length the width of the playing surface and is adapted to be pivoted towards the surface of the playing field against the tension of a spring 55 by means of the cables 56 or 57 when the player pulls on the handles 58 or 59 disposed at the ends of the cables at the sides of the game housing. By manipulating the handles 58 or 59 a player can control and determine when the ball disposed on the upper end 51 of the playing surface 26 will be projected by the pivoted bar 53 onto the playing surface and at what point on the plate 27 the ball will land. As the bar 53 is pivoted toward the playing surface it pushes any ball in the recessed lateral groove formed by the upper end flange 51 up and onto the playing surface.

Figure 5:
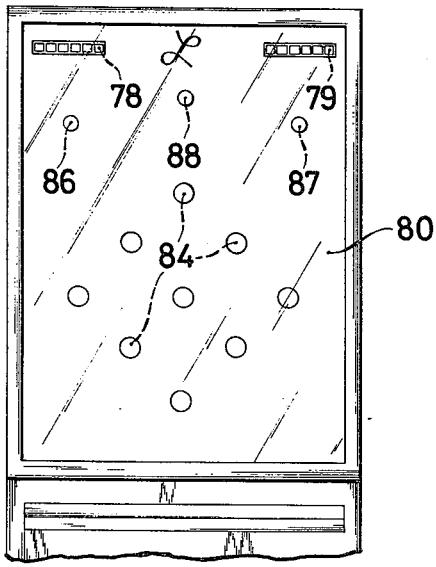
FIG. 5 shows an indicator panel for a ball game as shown in FIG. 4.

The ball game according to the invention can also be electrically operated, as indicated in FIG. 5. In this embodiment, angle pieces 62 and 63 of differing lengths are mounted on the underside of the plates 60 and 61, respectively. These angle pieces 62 and 63 bear rollers 65 and 64, respectively, on their ends. These rollers rest and travel on cam disks 66 and 67 which are attached to and rotated by a main shaft 68 which is driven by an electric motor 69 via step-down gearing 70 and belt pulleys 71 and 72 and belt 73. The motor 69 operates until a pin 74 of the main rotatable shaft 68 strikes against a disconnecting switch 75. Accordingly, the pin 74 is directed downwards in the rest position.

At the beginning of the automatic ball setting up operation, the rollers 64 and 65 only roll over a quarter of a circular path 76 for a quarter rotation and only the pin 74 moves past ten circular microswitches 77 which each sends a current pulse to one of the counters 78, 79 of an indicator panel 80 at the opposite or upper end of the playing surface if the microswitches 81 under each of the rods 82 are not kept in the blocking position by one of the pins 83 centrally disposed in the rods under the weight of the balls disposed thereabove. In other words, if the ball disposed on one of the rods 82 is shot off during play, the respective microswitch 81 not only releases the current for the respective light 84 on the indicator panel but the current pulse emitted by the microswitch 77 at the beginning of the automatic process can also indicate the number of balls which have been struck on the counters of the indicator panel.

A blocking switch 85 at the end of the row of microswitches 77 records the number of balls which have to be set up again and, on reaching the permitted number, it switches, for example, from the light 86 of team I to the light of team II which now continues the game. A light 88 which is red as opposed to the green lights 86 and 87 indicates that the automatic set-up system is in operation and that play should not be continued at this time.

If the total number of balls have come onto the plate 60 before all the available set-ups have been used, the plate 60 automatically drops down and releases a plurality of incoming balls, a sufficient number of which drop into the freed spaces of the openings 87. It should be noted that the cam disk 67 for pivoting the upper plate 60 comprises two protuberances 89 and 90 which produce an additional raising and lowering movement at the end of the upward movement of the upper plate 60, thereby preventing an odd superfluous ball from being supported in a fully centered position on the balls intended for the next game.

It is possible to operate the game manually in the event of a free ball becoming lodged behind one of the balls on the plate 60. The above-described operation for filling the plate is then repeated without showing any change on the indicator panel.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A table ball game comprising a housing, a long rectangular playing surface connected in said housing and having a surface opening adjacent one end thereof, an upper plate positioned in said surface opening having one side pivotally connected to said playing surface and having a surface in alignment with said playing surface and which slopes downwardly towards said one end in its normal position, said upper plate having cylindrical openings therethrough disposed at right angles to said surface thereof and of a size adapted to accommodate game balls therein, a lower plate disposed beneath and parallel to said upper plate and connected to move relative to said upper plate, upstanding cylindrical pins connected to said lower plate in registration with said cylindrical openings and having free ends which in their normal position terminate approximately in alignment with the surface of said upper plate and having small centrally disposed recesses on the said free ends, stationary guide means connected on the underside of each of said plates and extending at right angles to the respective plates, and operating means connected with said stationary guide means and operative to first move said lower plate away from said upper plate and axially move said upstanding cylindrical pins downwardly in the cylindrical openings in the upper plate by a distance to accommodate a game ball therein, subsequently pivot both of said plates in the position in which they are separated from one another in a downward direction away from the playing surface about the pivot connection of the upper plate with the playing surface, and finally return both of said plates in the reverse order to the normal positions thereof.

2. A table ball game as set forth in claim 1, in which said operating means includes a weak spring connected between the stationary guide means of each of said plates which constantly presses said lower plate towards said upper plate, a more powerful spring connected to urge said upper plate upwardly to its normal position, said operating means connected to first overpower the weak spring and press the said lower plate away from said upper plate by a distance of at least the radius of a game ball and then pivot both of said plates in a downward direction about the said pivot connection of the said upper plate by a distance of at least the full diameter of a game ball.

3. A table ball game as set forth in claim 1, in which said rectangular playing surface is steeply inclined to the horizontal, permanent magnets connected along the center axes of said upstanding cylindrical pins on said lower plate and being sufficiently powerful to magnetically retain game balls in the recesses on the free ends of said pins when moved back into their normal position but to magnetically release said game balls when they are struck by other game balls.

4. A table ball game as set forth in claim 3, including a spring projector for game balls connected in said housing, a ball projection channel in alignment with said spring projector and extending longitudinally of and adjacent to said playing surface, an arcuate guide at the opposite end of said channel from said projector, a recessed ball guide connected laterally across said playing surface at the opposite end of said playing surface and in communication with said arcuate guide, a bar movably connected in said recessed ball guide, and means connected to selectively move said bar from the recessed ball guide toward the playing surface to thereby push a ball in the lateral recessed ball guide into play at a selected lateral position at the said opposite end of the playing surface.

5. A table ball game as set forth in claim 1, in which said operating means include a main shaft connected for rotation in said housing beneath said lower plate, an electric motor connected to rotate said main shaft, two cam disks connected to said main shaft for rotation thereby, a roller connected on the end of the stationary guide means connected to each of said plates, and the roller of a respective plate in contact with the respective cam disk for imparting movement to said respective plate.

6. A table ball game as set forth in claim 5, in which said upstanding cylindrical pins on said lower plate have hollow axial bores, longitudinally displaceable pins in said hollow axial bores displaceable downwardly by the weight of a ball on the free end of a cylindrical pin, individual switch means for each cylindrical pin connected to said lower plate and connected for actuation by the longitudinal displacement of the longitudinally displaceable pins when a game ball is removed from the free end of a cylindrical pin.

7. A table ball game as set forth in claim 6, in which said two cam disks each include an idling portion, a radial pin connected to said main shaft for rotation therewith, a plurality of microswitches each in circuit with a respective one of said switch means disposed adjacent said main shaft in the path of movement of said radial pin and connected for sequential operation thereby during the idling portion of said cam disks and before movement of the said lower and upper plates.

8. A table ball game as set forth in claim 5 in which the cam disk for pivoting said upper plate includes at least two spaced protuberances on the periphery thereof in the position preceding the position of termination of disk rotation, for pivoting the said upper plate in a short reciprocating movement just before the rotation of the disk is terminated.

* * * * *